US011037699B2

(12) United States Patent
Gwag

(10) Patent No.: US 11,037,699 B2
(45) Date of Patent: Jun. 15, 2021

(54) POWER CABLE

(71) Applicant: LS CABLE & SYSTEM LTD., Anyang-si (KR)

(72) Inventor: Jae Cheol Gwag, Daegu (KR)

(73) Assignee: LS CABLE & SYSTEM LTD., Anyang-si (KR)

( * ) Notice: Subject to any disclaimer, the term of this patent is extended or adjusted under 35 U.S.C. 154(b) by 46 days.

(21) Appl. No.: 16/499,562

(22) PCT Filed: Mar. 31, 2017

(86) PCT No.: PCT/KR2017/003572
§ 371 (c)(1),
(2) Date: Sep. 30, 2019

(87) PCT Pub. No.: WO2018/182073
PCT Pub. Date: Oct. 4, 2018

(65) Prior Publication Data

US 2021/0098155 A1 Apr. 1, 2021

(30) Foreign Application Priority Data

Mar. 30, 2017 (KR) ..... 10-2017-0041078

(51) Int. Cl.
*H01B 9/02* (2006.01)
*H01B 7/02* (2006.01)
(Continued)

(52) U.S. Cl.
CPC ..... *H01B 9/027* (2013.01); *H01B 3/20* (2013.01); *H01B 7/0225* (2013.01); *H01B 7/1875* (2013.01); *H01B 7/22* (2013.01)

(58) Field of Classification Search
CPC ..... H01B 9/0688; H01B 9/02; H01B 9/0611; H01B 7/14
See application file for complete search history.

(56) References Cited

U.S. PATENT DOCUMENTS 3,662,092 A * 5/1972 Franco ..... H01B 7/28 174/120 FP
4,602,121 A * 7/1986 Priaroggia ..... H01B 7/14 174/25 R
(Continued)

FOREIGN PATENT DOCUMENTS

KR 1020140065241 A 5/2014
KR 20150092887 A 8/2015
(Continued)

OTHER PUBLICATIONS

Extended European Search Report for related European Application No. 17902843.6; action dated Nov. 16, 2020; (9 pages).
(Continued)

*Primary Examiner* — Timothy J Thompson
*Assistant Examiner* — Amol H Patel
(74) *Attorney, Agent, or Firm* — K&L Gates LLP

(57) ABSTRACT

Provided is a power cable, particularly, an ultra-high voltage underground or submarine cable for long-distance direct-current transmission. Specifically, the present invention relates to a power cable which includes an insulating layer of high dielectric strength, is capable of uniformly and effectively alleviating an electric field applied to the insulating layer, is particularly structurally stable, has high flexibility, and is capable of suppressing partial discharge, dielectric breakdown, etc. of the insulating layer, thereby increasing the lifespan and productivity of the cable.

20 Claims, 2 Drawing Sheets

(51) Int. Cl.

| | |
|---|---|
| ***H01B 7/22*** | (2006.01) |
| ***H01B 3/20*** | (2006.01) |
| ***H01B 7/18*** | (2006.01) |

(56) References Cited

U.S. PATENT DOCUMENTS 4,673,607 A * 6/1987 Hata ..... B32B 37/153 428/172
4,675,470 A 6/1987 Hata et al.
4,853,490 A * 8/1989 Bosisio ..... H01B 9/0611 174/25 R
4,967,039 A * 10/1990 Mohan ..... H01B 9/0688 174/25 C
4,994,632 A * 2/1991 Bosisio ..... H01B 7/0216 174/121 R
5,481,070 A * 1/1996 Hirose ..... H01B 9/0611 174/120 FP
6,207,261 B1 * 3/2001 Kuwabara ..... H01B 3/54 428/213
6,399,878 B2 * 6/2002 Kondo ..... H01B 3/22 174/25 R
2010/0206616 A1 * 8/2010 Motoi ..... H01B 13/08 174/25 R
2012/0285725 A1 * 11/2012 Maritano ..... H01B 3/52 174/120 FP
2014/0251654 A1 * 9/2014 Liu ..... H02G 15/103 174/25 R
2016/0049218 A1 * 2/2016 Liu ..... H01B 9/0688 428/377

FOREIGN PATENT DOCUMENTS

KR 20160097552 A 8/2016
KR 20160101643 A 8/2016
WO 2014161596 A1 10/2014

OTHER PUBLICATIONS

International Search Report for related International Application No. PCT/KR2017/003572; report dated Oct. 4, 2018;(3 pages).
Written Opinion for related International Application No. PCT/KR2017/003572; report dated Oct. 4, 2018; (6 pages).

* cited by examiner

POWER CABLE

CROSS-REFERENCE TO RELATED APPLICATIONS

The present application is a National Stage of International Application No. PCT/KR2017/003572, filed Mar. 31, 2017, which claims priority to Korean Application No. 10-2017-0041078, filed Mar. 30, 2017, the disclosure of which are incorporated herein by reference.

FIELD OF THE INVENTION

The present invention relates to a power cable, particularly, an ultra-high voltage underground or submarine cable for long-distance direct-current transmission. Specifically, the present invention relates to a power cable which includes an insulating layer of high dielectric strength, is capable of uniformly and effectively alleviating an electric field applied to the insulating layer, is particularly structurally stable, has high flexibility, and is capable of suppressing partial discharge, dielectric breakdown, etc. of the insulating layer, thereby increasing the lifespan and productivity of the cable.

BACKGROUND OF THE INVENTION

Power cables employing a polymeric insulator, such as cross-linked polyethylene (XLPE), as an insulating layer have been used. However, due to space charges formed at a high direct-current (DC) electric field, a paper-insulated cable having an insulating layer formed by impregnating insulating paper, which is cross-wound to cover a conductor, etc., with an insulating oil has been used as an ultra-high voltage DC transmission cable.

Examples of the paper-insulated cables include an oil-filled (OF) cable in which a low-viscosity insulating oil is circulated, a mass-impregnated non-draining (MIND) cable impregnated with a high or medium viscosity insulating oil, and the like. The OF cable is limited in terms of a length of transmission of a hydraulic pressure for circulation of the insulating oil and thus is not suitable as a long-distance transmission cable. Particularly, the OF cable is not suitable as a submarine cable because it is difficult to install insulating-oil circulation facility at the sea bottom.

Accordingly, the MIND cable is generally used as a long-distance DC transmission cable or an ultra-high voltage submarine cable.

An insulating layer of the MIND cable is formed by cross-winding insulating paper of a certain thickness and width in multiple layers. Kraft paper, semi-synthetic paper formed by stacking kraft paper and a thermoplastic resin such as polypropylene, or both kraft paper and the semi-synthetic paper may be used as the insulating paper.

In particular, a insulating paper may be cross-wound to form regular gaps between the widths of the insulating paper. When the plurality of sheets of insulating paper are cross-wound in multiple layers, the cross-winding may be performed by gap-winding such that the gaps in a certain layer among the multiple layers are covered with a insulating paper forming an upper layer and a lower layer of the layer.

However, only an insulating oil of lower resistivity than that of an insulating oil in the insulating paper is contained in the gaps and thus an electric field may be concentrated in the gaps. Furthermore, as the insulating oil filled in the gaps shrinks, expands, or moves according to an operating state of the cable, temperature of an environment in which the cable is installed, or the like, oil-free voids containing no insulating oil may occur in the insulating layer. An electric field may be concentrated in the oil-free voids and thus partial discharge, dielectric breakdown, or the like may occur starting from the oil-free voids, thereby shortening the lifespan of the cable.

To avoid this problem, it may be considered to reduce the gaps. However, in this case, the efficiency of cross-winding the insulating paper may decrease, thereby lowering the productivity of the cable, and a plurality of sheets of insulating paper arranged within a radius of curvature may collide with each other and thus be broken or the flexibility of the cable may decrease when the cable is bent.

Accordingly, there is an urgent need for a power cable which has an insulating layer of high dielectric strength, is capable of uniformly and effectively alleviating an electric field applied to the insulating layer, is particularly structurally stable, has high flexibility, and capable of suppressing partial discharge, dielectric breakdown, etc. of the insulating layer, thereby increasing the lifespan and productivity of the cable.

BRIEF SUMMARY OF THE INVENTION

The present invention is directed to providing a power cable, in which an insulating layer has high dielectric strength and an electric field applied to the insulating layer may be uniformly and effectively alleviated.

The present invention is also directed to providing a power cable which is structurally stable, has high flexibility, and capable of suppressing partial discharge, dielectric breakdown, etc. of an insulating layer, thereby increasing the lifespan and productivity of the cable.

According to an aspect of the present invention, provided is a power cable comprising: a conductor; an inner semi-conductive layer covering the conductor; an insulating layer covering the inner semi-conductive layer and impregnated with an insulating oil; an outer semi-conductive layer covering the insulating layer; a metal sheath layer covering the outer semi-conductive layer; and a cable protective layer covering the metal sheath layer, wherein the insulating layer is formed by sequentially stacking an inner insulating layer, an intermediate insulating layer, and an outer insulating layer, wherein the inner insulating layer and the outer insulating layer are formed by cross-winding kraft paper by gap winding and impregnating the kraft paper with the insulating oil, the intermediate insulating layer is formed by cross-winding semi-synthetic paper by gap winding and impregnating the semi-synthetic paper with the insulating oil, the semi-synthetic paper including a plastic film and kraft paper stacked on at least one side of the plastic film, the gap winding is performed by cross-winding a kraft paper or semi-synthetic paper to form regular gaps between the widths of the kraft paper or semi-synthetic paper, and repeatedly cross-winding a new kraft paper or semi-synthetic paper on the kraft paper or semi-synthetic paper to cover the gaps with the new kraft paper or semi-synthetic paper while gaps are formed between the widths of the new kraft paper or semi-synthetic paper, the intermediate insulating layer is divided into at least two layers according to a width of the semi-synthetic paper thereof, wherein, when a layer more adjacent to the conductor among the at least two layers is a lower layer and a layer located at an outer side of the lower layer is an upper layer, the width of the semi-synthetic paper forming the upper layer is greater than that of the semi-synthetic paper forming the lower layer, and a width of the gaps between the widths of the semi-synthetic paper, which are formed by gap-winding the semi-synthetic paper, is 5 to 15% of that of the semi-synthetic paper.

According to another of the present invention, provided is the power cable, wherein in the upper layer and the lower layer adjacent to each other, the width of the semi-synthetic paper forming the upper layer is 105 to 125% of that of the semi-synthetic paper forming the lower layer.

According to other of the present invention, provided is the power cable, wherein the width of the semi-synthetic paper forming the intermediate insulating layer adjacent to the inner insulating layer is the same as that of the semi-synthetic paper forming the inner insulating layer adjacent thereto.

According to other of the present invention, provided is the power cable, wherein layers cross-wound a plurality of times in an S direction and layers cross-wound a plurality of times in a Z direction are alternately included in the insulating layer, and the intermediate insulating layer comprises at least two layers cross-wound in the S direction or the Z direction.

According to other of the present invention, provided is the power cable, wherein the width of the semi-synthetic paper forming the S-direction wound layers or the Z-direction wound layers of the intermediate insulating layer is the same in the same S-direction wound layer or the same Z-direction wound layer.

According to other of the present invention, provided is the power cable, wherein the number of times of winding the semi-synthetic paper in the same S-direction wound layer or the same Z-direction wound layer among the S-direction wound layers or the Z-direction wound layers of the intermediate insulating layer is 16 or less.

According to other of the present invention, provided is the power cable, wherein, in the insulating layer, the difference between a sum of the numbers of times of winding the S-direction wound layers and a sum of the numbers of times of winding the Z-direction wound layers does not exceed ±10% of the sum of the numbers of times of winding the S-direction wound layers.

According to other of the present invention, provided is the power cable, wherein the inner semi-conductive layer is formed by cross-winding the semi-conductive paper by gap winding and impregnating the semi-conductive paper with the insulating oil, and the outer semi-conductive layer is formed by cross-winding the semi-conductive paper by gap winding and impregnating the semi-conductive paper with the insulating oil, wherein the outer semi-conductive layer comprises: a lower layer formed by cross-winding the semi-conductive paper by gap winding and impregnating the semi-conductive paper with the insulating oil; and an upper layer formed by cross-winding the semi-conductive paper and metallized paper together by lap winding and impregnating the semi-conductive paper and the metallized paper with the insulating oil.

According to other of the present invention, provided is the power cable, wherein a thickness of the inner insulating layer is 1 to 10%, a thickness of the intermediate insulating layer is 75% or more, and a thickness of the outer insulating layer is 5 to 15%, based on a total thickness of the insulating layer, and resistivities of the inner insulating layer and the outer insulating layer are less than resistivity of the intermediate insulating layer.

According to other of the present invention, provided is the power cable, wherein the thickness of the outer insulating layer is greater than that of the inner insulating layer.

According to other of the present invention, provided is the power cable, wherein the thickness of the outer insulating layer is 1 to 30 times the thickness of the inner insulating layer.

According to other of the present invention, provided is the power cable, wherein a thickness of the kraft paper of each of the inner insulating layer and the outer insulating layer is less than that of the kraft paper included in the semi-synthetic paper.

According to other of the present invention, provided is the power cable, wherein a maximum impulse electric field value of the inner insulating layer is less than that of the intermediate insulating layer.

According to other of the present invention, provided is the power cable, wherein a maximum impulse electric field value of the intermediate insulating layer is 100 kV/mm or less. According to other of the present invention, provided is the power cable, wherein a thickness of the plastic film is 40 to 70% of a total thickness of the semi-synthetic paper.

According to other of the present invention, provided is the power cable, wherein the conductor is formed of annealed copper wire or aluminum, wherein the conductor comprises a flat conductor formed by stacking flat element wires in multiple layers on a round center wire or a circularly compressed conductor formed by stacking and compressing round element wires in multiple layers on a round center wire.

According to other of the present invention, provided is the power cable, wherein the plastic film is formed of a polypropylene homopolymer resin.

According to other of the present invention, provided is the power cable, wherein the insulating oil comprises a high-viscosity insulating oil of kinematic viscosity of 500 centistokes (Cst) or more at 60° C.

According to other of the present invention, provided is the power cable, wherein the cable protective layer comprises an inner sheath, a bedding layer, a metal reinforcement layer and an outer sheath.

According to other of the present invention, provided is the power cable, wherein the cable protective layer further comprises a wire sheath and an outer sheath layer.

In a power cable according to the present invention, a structure of an insulating layer is precisely designed and thus the insulating layer has high dielectric strength and an electric field applied to the insulating layer can be alleviated uniformly and effectively to suppress partial discharge, insulation breakdown, etc. from occurring due to the concentration of the electric field, thereby increasing the lifespan of the cable.

In addition, the width of insulating paper forming the insulating layer is precisely designed, the power cable according to the present invention is structurally stable, has high flexibility, and is capable of suppressing partial discharge, dielectric breakdown, etc. of the insulating layer, thereby increasing the lifespan and productivity of the cable.

DETAILED DESCRIPTION OF THE INVENTION

Hereinafter, exemplary embodiments of the present invention will be described in detail. The present invention is, however, not limited thereto and may be embodied in many different forms. Rather, the embodiments set forth herein are provided so that this disclosure will be thorough and complete, and fully convey the scope of the invention to those skilled in the art. Throughout the specification, the same reference numbers represent the same elements.

Figure 1:
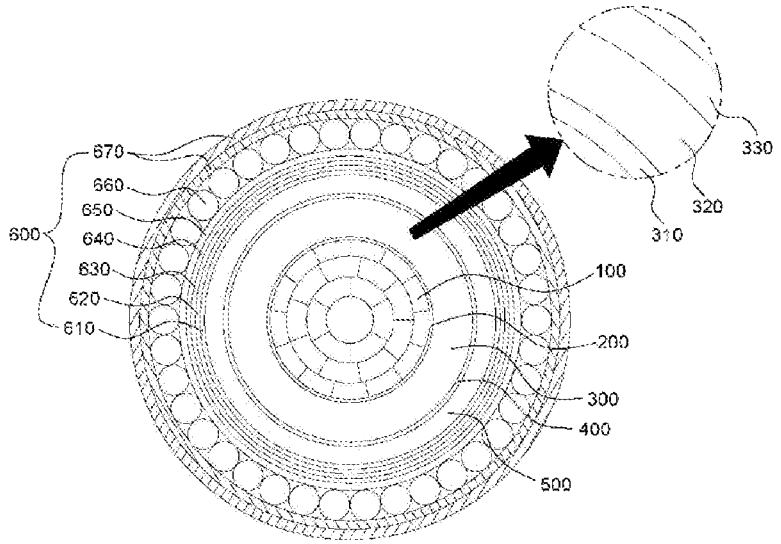
FIG. 1 schematically illustrates a cross section of a power cable according to the present invention.
Figure 2:
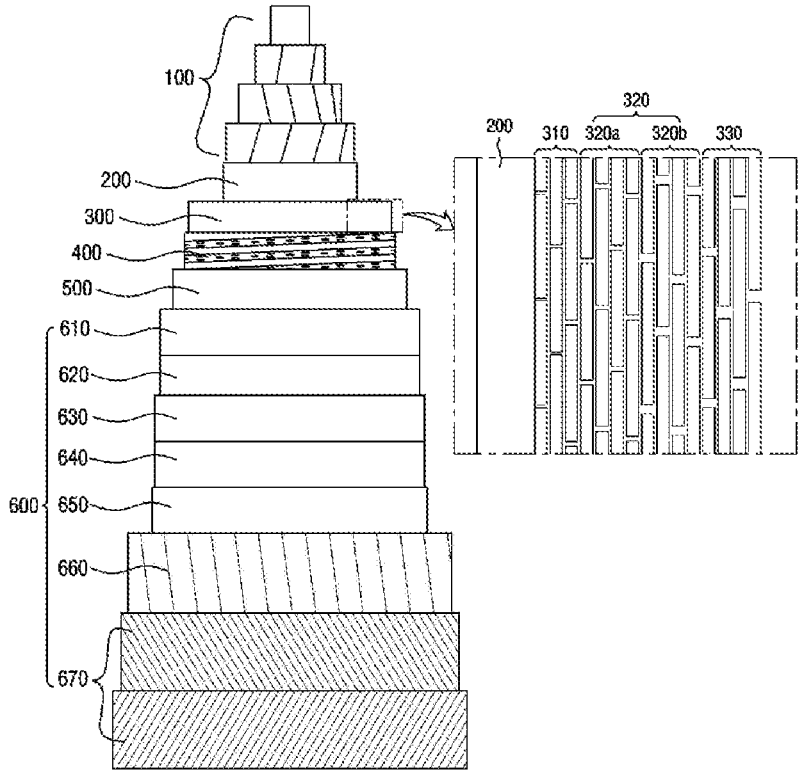
FIG. 2 schematically illustrates a longitudinal section of the power cable of FIG. 1.

FIGS. 1 and 2 schematically illustrate a cross section and a longitudinal section of a power cable according to the present invention, respectively.

As illustrated in FIGS. 1 and 2, the power cable of the present invention may include a conductor 100, an inner semi-conductive layer 200 covering the conductor 100, an insulating layer 300 covering the inner semi-conductive layer 200, an outer semi-conductive layer 400 covering the insulating layer 300, a metal sheath layer 500 covering the outer semi-conductive layer 400, a cable protective layer 600 covering the metal sheath layer 500, and the like.

The conductor 100 may serve as a current moving path for transmission of current, and may be formed of high-purity copper (Cu), aluminum (Al), or the like having high conductivity to minimize power loss and having appropriate strength and flexibility to be used as a conductor of a cable, and particularly, annealed copper wire having high elongation and high conductivity. A cross-sectional area of the conductor 100 may vary according to a power transmission rate, usage, etc. of the cable.

Preferably, the conductor 100 may include a flat conductor formed by stacking flat element wires in multiple layers on a round center wire or a circularly compressed conductor formed by stacking and compressing round element wires in multiple layers on a round center wire. The conductor 100 including a flat conductor formed by a so-called keystone method is economical, because an outer diameter of the cable may be reduced due to a high space factor of the conductor 100 and the cross-sectional area of each element wire of the conductor 100 may be increased to reduce the total number of element wires.

The inner semi-conductive layer 200 may suppress distortion and concentration of an electric field due to an irregular surface of the conductor 100 to suppress partial discharge, dielectric breakdown, etc. due to the concentration of an electric field at an interface between the inner semi-conductive layer 200 and the insulating layer 300 or in the insulating layer 300.

The inner semi-conductive layer 200 may be formed by cross-winding semi-conductive paper, e.g., carbon paper obtained by applying a conductive material such as carbon black onto insulating paper or a film formed of a polymer composite material in which a conductive material such as carbon black is dispersed. About 3 to 10 sheets of the semi-conductive paper may be cross-wound. The inner semi-conductive layer 200 may have a thickness of about 0.2 to 3.0 mm.

The insulating layer 300 may be formed by winding insulating paper in multiple layers. For example, either kraft paper or semi-synthetic paper formed by stacking kraft paper and a thermoplastic resin such as polypropylene resin may be used as the insulating paper.

According to an exemplary embodiment of the present invention, the insulating layer 300 may include an inner insulating layer 310, an intermediate insulating layer 320, and an outer insulating layer 330. The inner insulating layer 310 and the outer insulating layer 330 may be formed of a material of lower resistivity than that of the intermediate insulating layer 320. Thus, the inner insulating layer 310 and the outer insulating layer 330 may alleviate an electric field to prevent a high electric field, which is applied to the cable during an operation of the cable, from being applied directly onto the conductor 100 or directly below the metal sheath layer 500, and may suppress deterioration of the intermediate insulating layer 320.

Figure 3:
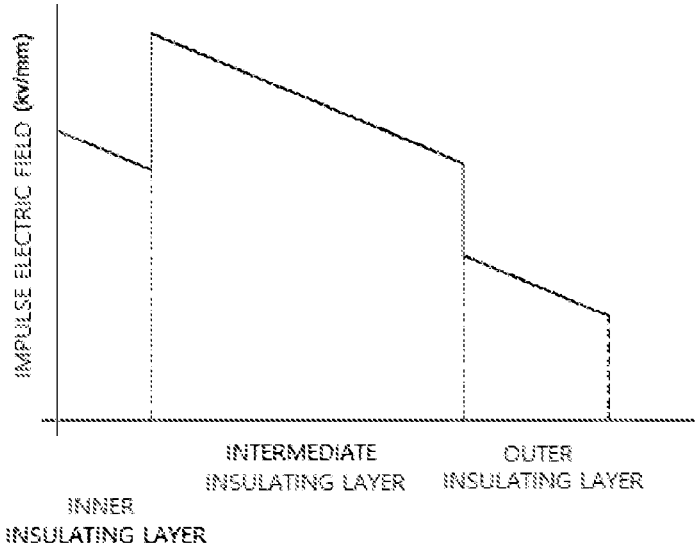
FIG. 3 is a graph schematically showing a process of reducing an electric field in an insulating layer of a power cable according to the present invention.
Figure 4:
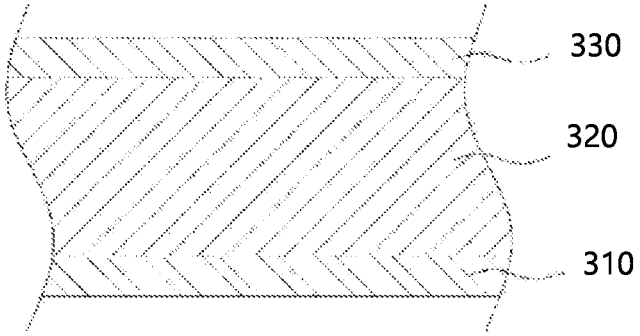
FIG. 4 is a schematic cross-sectional view of semi-synthetic paper forming an intermediate insulating layer of the power cable of FIG. 1.

FIG. 3 is a graph schematically showing a process of reducing an electric field in an insulating layer of a power cable according to the present invention. As illustrated in FIG. 3, a DC electric field may be reduced by the inner insulating layer 310 and the outer insulating layer 330 having relatively low resistivity and thus a high electric field generally generated in a DC cable may be effectively suppressed from being applied directly onto the conductor 100 and directly below the metal sheath layer 500. In the case of an impulse, deterioration of the inner insulating layer 310 may be suppressed by reducing a high impulse electric field to be applied to the inner insulating layer 310 while controlling a maximum impulse electric field to be applied to the intermediate insulating layer 320 to be 100 kV/mm or less. Thus, deterioration of the intermediate insulating layer 320 may be also suppressed. Here, the impulse electric field refers to an electric field applied to the cable when an impulse voltage is applied to the cable.

Therefore, as illustrated in FIG. 3, a maximum impulse electric field value of the inner insulating layer 310 is designed to be less than that of the intermediate insulating layer 320, so that a high electric field may not be applied directly onto the conductor 100 and directly below the metal sheath layer 500. A maximum impulse electric field applied to the intermediate insulating layer 320 is equal to an internal electric field of the intermediate insulating layer 320. The internal electric field may be controlled to be equal to or less than an allowable impulse electric field, e.g., 100 kV/mm, of the intermediate insulating layer 320, thereby suppressing deterioration of the intermediate insulating layer 320.

Thus, a high electric field may be suppressed from being applied to the inner insulating layer 310 and the outer insulating layer 330, and particularly, to a cable connection member vulnerable to an electric field, and furthermore, the intermediate insulating layer 320 may be made compact while maximizing the performance thereof. Accordingly, a compact cable having an internal impulse pressure higher than that of a general cable may be achieved and a decrease in the lifespan of the cable may be suppressed.

In an embodiment of the present invention, the inner insulating layer 310 and the outer insulating layer 330 may be formed by cross-winding kraft paper made of kraft pulp and impregnating the kraft paper with an insulating oil and thus may have lower resistivity and higher permittivity than those of the intermediate insulating layer 320. The kraft paper may be prepared by removing organic electrolytes from the kraft pulp and cleaning the kraft pulp with deionized water to obtain a high dielectric tangent and high permittivity.

The intermediate insulating layer 320 may be formed by cross-winding semi-synthetic paper in which kraft paper is stacked on an upper surface or a lower surface of a plastic film or both the upper and lower surfaces and then impregnating the semi-synthetic paper with the insulating oil. The intermediate insulating layer 320 formed as described above includes the plastic film and thus has high resistivity, low permittivity, a high DC breakdown voltage, and a high impulse breakdown voltage, compared to the inner insulating layer 310 and the outer insulating layer 330. The outer diameter of the cable may be reduced in terms of DC current due to the high resistivity of the intermediate insulating layer 320, and reduced in terms of impulse due to the low permittivity of the intermediate insulating layer 320.

In the semi-synthetic paper forming the intermediate insulating layer 320, the plastic film prevents the insulating oil impregnated in the insulating layer 300 from moving toward the outer semi-conductive layer 400 due to heat generated during operation of the cable, thereby suppressing oil-free voids from occurring due to the movement of the insulating oil. Accordingly, it is possible to suppress concentration of an electric field and dielectric breakdown due to the oil-free voids. Here, the plastic film may be formed of polyolefin-based resin such as polyethylene, polypropylene or polybutylene, or fluorine resin such as tetrafluoroethylene-hexafluoro polypropylene copolymer, ethylene-tetrafluoroethylene copolymer, and preferably, polypropylene homopolymer resin having high heat resistance.

A thickness of the plastic film may be 40 to 70% of the total thickness of the semi-synthetic paper. When the thickness of the plastic film is less than 40% of the total thickness of the semi-synthetic paper, the outer diameter of the cable may increase due to insufficient resistivity of the intermediate insulating layer 320. In contrast, when the thickness of the plastic film is greater than 70% of the total thickness of the semi-synthetic paper, the semi-synthetic paper may be difficult to manufacture and thus the cost may be expensive.

The inner insulating layer 310 may be formed by cross-winding 11 to 21 sheets of kraft paper and have a thickness of 1 to 10% of the total thickness of the insulating layer 300, the outer insulating layer 330 may have a thickness of 5 to 15% of the total thickness of the insulating layer 300, and the intermediate insulating layer 320 may be formed by cross-winding 140 to 168 sheets of the semi-synthetic paper and have a thickness of 75% of the total thickness of the insulating layer 300.

Thus, a maximum impulse electric field value of the inner insulating layer 310 may be lower than that of the intermediate insulating layer 320. When the thickness of the inner insulating layer 310 is increased more than necessary, the maximum impulse electric field value of the intermediate insulating layer 320 becomes greater than a permissible maximum impulse electric field value. In order to alleviate this problem, the outer diameter of the cable should be increased. It is preferable that the thickness of the outer insulating layer 330 be sufficiently greater than that of the inner insulating layer 310 as will be described below.

In addition, in the present invention, the inner insulating layer 310 and the outer insulating layer 330 each having low resistivity are provided to suppress a high DC electric field from being applied directly onto the conductor 100 and directly below the metal sheath layer 500. Furthermore, the thickness of the intermediate insulating layer 320 having high resistivity is designed to be 75% or more so as to reduce the outer diameter of the cable.

As described above, the thicknesses of the inner insulating layer 310, the intermediate insulating layer 320, and the outer insulating layer 330 of the insulating layer 300 may be precisely controlled to minimize the outer diameter of the cable while achieving desired dielectric strength of the insulating layer 300. In addition, a direct current and an impulse to be applied to the insulating layer 300 may be most effectively designed, and high electric fields of the direct current and the impulse may be suppressed from being applied directly onto the conductor 100 and directly below the metal sheath layer 500 to avoid deterioration of dielectric strength of a cable connection member particularly vulnerable to an electric field and other physical properties Preferably, the outer insulating layer 330 may be formed by cross-winding 20 to 32 sheets of the kraft paper and may have a thickness greater than that of the inner insulating layer 310. For example, in the case of a 500 kV DC cable, the thickness of the inner insulating layer 310 may be 1.0 to 2.0 mm, the thickness of the outer insulating layer 330 may be 2.0 to 3.0 mm, and the thickness of the intermediate insulating layer 320 may be 15 to 25 mm.

Heat generated during a lead-joining work for connection of the cable of the present invention may be supplied to the insulating layer 300 and thus the plastic film of the semi-synthetic paper forming the intermediate insulating layer 320 may be melted by the heat. Thus, in order to protect the plastic film from the heat, the outer insulating layer 330 should be formed to a sufficient thickness and is preferably thicker than the inner insulating layer 310. The thickness of the outer insulating layer 330 may be 1 to 30 times that of the inner insulating layer 310.

A sheet of the semi-synthetic paper forming the intermediate insulating layer 320 may have a thickness of 70 to 200 μm, and the kraft paper forming the inner and outer insulating layers 310 and 320 may have a thickness of 50 to 200 μm. The thickness of the kraft paper of the inner and outer insulating layers 310 and 320 may be greater than that of the kraft paper included in the semi-synthetic paper.

The insulating oil impregnated in the insulating layer 300 is fixed not to be circulated, unlike an insulating oil used in existing OF cables, and thus, an insulating oil of relatively high viscosity is used. The insulating oil may be used to not only achieve desired dielectric strength of the insulating layer 300 but also to function as a lubricant to facilitate the movement of the insulating paper when the cable is bent.

The insulating oil is not particularly limited, but should not be oxidized by heat when in contact with copper and aluminum of the conductor 100, should have sufficiently low viscosity at an impregnation temperature, e.g., 100° C., or more to facilitate the impregnation of the insulating oil 310 with the insulating oil, and should have sufficiently high viscosity at an operating temperature, e.g., 60 to 90° C., or more not to flow down during an operation of the cable. For example, a high-viscosity insulating oil of kinetic viscosity of 500 centistokes (cSt) or more at 60° C., and particularly, a mixture of at least one insulating oil selected from the group consisting of naphthenic insulating oil, polystyrene-based insulating oil, mineral oil, alkyl benzene or polybutene-based synthetic oil, heavy alkylate, etc. may be used.

However, the present invention is not limited thereto, and a middle-viscosity insulating oil of viscosity lower than that of the high-viscosity insulating oil, e.g., an insulating oil of kinetic viscosity of 5 to 500 centistokes (cSt) at 60° C., may be used.

A process of impregnating the insulating layer 300 with the insulating oil may be performed by cross-winding the kraft paper and the semi-synthetic paper a plurality of times to form the inner insulating layer 310, the intermediate insulating layer 320 and the outer insulating layer 330 to desired thicknesses, vacuum-drying these layers to remove residual moisture from the insulating layer 300, impregnating the insulating layer 300 with the insulating oil for a certain time by injecting into a tank the insulating oil heated to a high impregnation temperature, e.g., 100 to 120° C., in a high pressure environment, and gradually cooling the insulating oil.

The outer semi-conductive layer 400 suppresses a non-uniform electric field distribution between the insulating layer 300 and the metal sheath layer 500, alleviates the electric field distribution, and physically protects the insulating layer 300 from the metal sheath layer 500 which may have various shapes.

The outer semi-conductive layer 400 may be formed, for example, by cross-winding semi-conductive layer such as carbon black obtained by processing insulating paper with conductive carbon black, and preferably includes a lower layer formed by cross-winding the semi-conductive paper and an upper layer formed by cross-winding the semi-conductive paper and metallized paper by lap winding, i.e., such that the metallized paper and the semi-conductive paper overlap each other by a certain percentage, e.g., about 40 to 60%. 1 to 4 sheets of the semi-conductive paper and/or the metallized paper forming the outer semi-conductive layer 400 may be cross-wound and the thickness of the outer semi-conductive layer 400 may be about 0.1 to 3.0 mm.

Here, the metallized paper may have a structure in which a metal foil such as aluminum tape or aluminum foil is stacked on base paper such as kraft paper or carbon paper. The metal foil may include a plurality of perforations via which the insulating oil may easily penetrate into semi-conductive paper, insulating paper, semi-synthetic paper, etc. below the metal foil. Thus, the semi-conductive paper of the lower layer may come into smooth electrical contact with the metal foil of the metallized paper via the semi-conductive paper of the upper layer. As a result, the outer semi-conductive layer 400 and the metal sheath layer 500 may come into smooth electrical contact with each other, and thus, a return of fault current may be effectively secured to ensure safety when a ground or short circuit accident occurs in the cable, and a uniform electric field distribution may be formed between the insulating layer 300 and the metal sheath layer 500.

In addition, a woven copper-wire fabric (not shown) may be additionally included in the outer semi-conductive layer 400 between the outer semi-conductive layer and the metal sheath layer 500. The woven copper-wire fabric has a structure in which 2 to 8 strands of copper wire are directly inserted into non-woven fabric, and may be used to firmly bind the semi-conductive paper, the metallized paper, etc., which are wound together to form the outer semi-conductive layer 400, to be maintained in the above-described structure without being untied and may be additionally used to bring the outer semi-conductive layer 400 and the metal sheath layer 500 in contact with each other through the copper wire.

In particular, in the power cable of the present invention, the semi-conductive paper forming the inner semi-conductive layer 200, the kraft paper forming the inner insulating layer 310 and the outer insulating layer 330 of the insulating layer 300, and the semi-synthetic paper forming the intermediate insulating layer 320, the semi-conductive paper forming the outer semi-conductive layer 200, etc. (hereinafter referred to as 'semi-conductive paper, etc.') are repeatedly cross-wound by gap winding, i.e., such that regular gaps are formed between the widths of the semi-conductive paper, etc. and covered with a new semi-conductive paper while gaps are formed between the new semi-conductive paper when the new semi-conductive paper are wound on the plurality of sheets of semi-conductive paper.

Thus, the insulating oil may easily move via the gaps and thus be uniformly impregnated in the insulating layer 300 and an impregnation time may be reduced, thereby improving the productivity of the cable.

In addition, the semi-conductive paper, etc. may slide left and right through free spaces of the gaps at the left and right sides thereof and thus the structure thereof may be stably maintained without colliding with semi-conductive paper adjacent thereto even when the cable is bent. Therefore, the width of the gaps should be secured in proportion to that of the semi-conductive paper, etc. so that a plurality of sheets of semi-conductive paper may slide stably without colliding with each other. For example, the width of the gaps between the plurality of sheets of the semi-conductive paper may be about 5 to 15% of the width of the semi-conductive paper, etc.

Here, if the width of the gaps is less than 5% of that of the semi-conductive paper, etc., the semi-conductive paper, etc. may collide with each other and thus be damaged when the cable is bent. If the width of the gap is greater than 15% of that of the semi-conductive paper, etc., the semi-conductive paper, etc. may protrude via a gap in an upper or lower layer thereof and thus be broken or a layer structure may be deformed, when the cable is bent.

In the insulating layer 300, only an insulating oil of lower resistivity than that of the insulating oil in the insulating paper of the insulating layer 300 is contained in the gaps between the widths of the insulating paper such as the kraft paper and the semi-synthetic paper, and thus, an electric field may be concentrated in the gaps and partial discharge, dielectric breakdown, etc. may occur starting from the gaps, thereby shortening the lifespan of the cable.

Therefore, according to the present invention, the width of the insulating paper, such as kraft paper and semi-synthetic paper, for forming the insulating layer 300 and the width of the gaps according thereto are precisely adjusted to secure high dielectric strength of the insulating layer 300 while increasing the productivity, flexibility, etc. of the cable which are in a tradeoff relation with the dielectric strength of the insulating layer 300.

Specifically, when the intermediate insulating layer 320 of the insulating layer 300, which is formed by cross-winding the semi-synthetic paper, is divided into at least two layers according to the width of the semi-synthetic paper, a layer closest to the conductor 100 among the at least two layers is a lower layer 320*a* and a layer located at an outer side of the lower layer 320*a* is an upper layer 320*b*, a width of the semi-synthetic paper of the upper layer 320*b* may be greater than that of the semi-synthetic paper of the lower layer 320*a*.

That is, when electric current is supplied to the cable, not only the width of the insulating paper of the lower layer 320*a* which is most adjacent to the conductor 100 and to which a relatively strong electric field is thus applied but also the width of the gaps containing only the insulating oil of relatively low resistivity may be adjusted to be narrow, thereby effectively suppressing a decrease in total dielectric strength due to the gaps. Because the lower layer 320*a* is located inside the cable, a radius of curvature thereof is low when the cable is bent, and thus, collision of a plurality of sheets of insulating paper with each other may be avoided to prevent them from being broken or a structure thereof from being deformed even when gaps in the lower layer 320*a* are designed to be relatively narrow.

The upper layer 320*b* is farther from the conductor 100 than the lower layer 320*a* and thus a relatively weak electric field is applied thereto when electric current is supplied to the cable. Thus, even when the width of gaps therein containing only the insulating oil of relatively low resistivity is increased to a certain extent, the total dielectric strength of the insulating layer 300 is not greatly influenced. Furthermore, the width of the insulating paper may be adjusted to be increased by increasing the width of the gaps in the upper layer 320*b*. Therefore, an efficiency of cross-winding the insulating paper to form the upper layer 320*b* may be improved to increase the productivity of the cable. In addition, when the cable is bent, the collision of a plurality of sheets of the insulating paper with each other in the upper layer 320*b* of a high radius of curvature may be avoided to prevent the insulating paper from being broken or structurally deformed.

Here, in the upper layer 320*b* and the lower layer 320*a* which are adjacent to each other, the width of the semi-synthetic paper forming the upper layer 320*b* may be 105 to 125% of that of the semi-synthetic paper forming the lower layer 320*a*. For example, the insulating paper forming the lower layer 320*a* may have a width of 20 to 30 mm, the insulating paper forming the upper layer 320*b* may have a width of 23 to 33 mm, and insulating paper forming an additional upper layer on the upper layer 320*b* may have a width of 27 to 34 mm.

In addition, gaps between a plurality of sheets of the insulating paper forming the lower layer 320*a* may be about 1.5 to 2.5 mm, gaps between a plurality of sheets of the insulating paper forming the upper layer 320*b* may be about 2.1 to 2.7 mm, and a plurality of sheets of the insulating paper forming the additional upper layer may be about 2.3 to 3.0 mm.

In particular, the width of the semi-synthetic paper forming the intermediate insulating layer 320 adjacent to the inner insulating layer 310 may be the same as that of the semi-synthetic paper forming the inner insulating layer 310. This is because an electric field distribution may become unstable due to a sudden change of an electric field at a border between the inner insulating layer 310 formed of kraft paper is switched to the intermediate insulating layer 320 formed of semi-synthetic paper and thus partial discharge, dielectric breakdown, etc. may occur due to a local concentration of the electric field.

The width of the kraft paper forming the inner insulating layer 310 and the width of the semi-conductive paper forming the inner semi-conductive layer 200 may be independently 20 to 30 mm. The width of the kraft paper forming the outer insulating layer 330 and the width of semi-conductive paper and the metallized paper forming the outer semi-conductive layer 400 may be independently 27 to 34 mm. The width of the woven copper-wire fabric which may be additionally included in the outer semi-conductive layer 400 may be about 60 to 110 mm. The width of the gaps between widths of the kraft paper, the semi-conductive paper, or the like of each layer may be about 5 to 15% of the width of each of the kraft paper, the semi-conductive paper or the like of each layer.

A direction in which the semi-conductive paper, etc. forming the inner semi-conductive layer 200 to the outer semi-conductive layer 400 of the power cable of the present invention is wound may be alternately changed for every certain number of sheets of paper to stabilize the structure of the cable, improve the flexibility of the cable, and uniformize the appearance of the cable.

Here, layers cross-wound a plurality of times in an S-direction and layers cross-wound a plurality of times in a Z-direction may be alternately included in the insulating layer 300, and the intermediate insulating layer 320 may include two or more layers cross-wound in the S-direction or the Z-direction.

The width of the semi-synthetic paper forming the S-direction wound layers or the Z-direction wound layers of the intermediate insulating layer 320 may be the same in the same S-direction wound layer or the same Z-direction wound layer.

In particular, the number of times of cross-winding the semi-synthetic paper included in the same S-direction or Z-direction wound layer among the S-direction or Z-direction wound layers of the intermediate insulating layer 320 may be 16 or less. Furthermore, in the insulating layer 300, the difference between the sum of the numbers of times of cross-winding the S-direction wound layers and the sum of the numbers of times of cross-winding the Z-direction wound layers may not exceed ±10% of the sum of the numbers of times of cross-winding the S-direction wound layers. Therefore, the insulating layer 300 may be prevented from being twisted after the insulation oil is impregnated therein.

In detail, the semi-conductive paper forming the inner semi-conductive layer 200 may be cross-wound in the S direction, the kraft paper forming the inner insulating layer 310 may be cross-wound in the Z direction, and every 12 to 16 sheets of the semi-synthetic paper forming the intermediate insulating layer 320 may be alternately cross-wound in the S direction and the Z direction. Preferably, 16 sheets of the semi-synthetic paper of the intermediate insulating layer 320 may be alternately cross-wound in the S direction and the Z direction, 14 sheets thereof may be alternately cross-wound in the S direction and the Z direction, and then 12 sheets thereof may be alternately cross-wound in the S direction and the Z direction. In particular, a certain number of sheets of the semi-synthetic paper corresponding to an uppermost layer of the intermediate insulating layer 320 may be lap-wound with a certain number of sheets of the kraft paper corresponding to a lowermost layer of the outer insulating layer 330, thereby greatly stabilizing the structure of the cable and achieving a uniform electric field through additional buffering of the electric field. Every 8 to 10 sheets of the kraft paper forming the outer insulating layer 330 may be alternately cross-wound in the S direction and the Z direction. In the case of the outer semi-conductive layer 400, 1 to 4 sheets of the semi-conductive paper may be cross-wound, 1 to 2 sheets of the semi-conductive paper and the metallized paper may be lap-wound on the semi-conductive paper, and a sheet of the woven copper-wire fabric may be cross-wound on the wound semi-conductive paper and metallized paper.

The metal sheath layer 500 prevents the insulating oil from leaking to the outside from the inside of the cable, prevents an electric field from leaking to the outside of the cable to achieve an electrostatic shielding effect, functions as a return of fault current by grounding one end of the cable when a ground or short-circuit accident occurs, thereby ensuring safety, protects the cable from external impacts, pressure, etc., and improves the watertightness, flame retardancy, etc. of the cable.

The metal sheath layer 500 may be, for example, a lead sheath formed of pure lead or a lead alloy. As the metal sheath layer 500, the lead sheath may also function as a high-current conductor owing to relatively low electrical resistance thereof, and may additionally improve watertightness, mechanical strength, fatigue characteristics, etc. of the cable, when formed as a seamless type.

Furthermore, a corrosion inhibiting compound, e.g., blown asphalt, may be applied on a surface of the lead sheath to additionally improve corrosion resistance, watertightness, etc. of the cable and improve adhesion between the metal sheath layer 500 and the cable protection layer 600.

The cable protection layer 600 may include, for example, a metal reinforcement layer 630 and an outer sheath 650, and may further include an inner sheath 610 and bedding layers 620 and 640 on and below the metal reinforcement layer 630. Here, the inner sheath 610 improves corrosion resistance, watertightness, etc. of the cable, and protects the cable from mechanical trauma, heat, fire, ultraviolet rays, insects or animals. The inner sheath 610 is not particularly limited but may be formed of polyethylene of excellent cold resistance, oil resistance, chemical resistance, etc., polyvinyl chloride of excellent chemical resistance, flame resistance, etc., or the like.

The metal reinforcing layer 630 protects the cable from mechanical stress, and may be formed of galvanized steel tape, stainless steel tape, or the like to prevent corrosion. A corrosion inhibiting compound may be applied to a surface of the galvanized steel tape. The bedding layers 620 and 640 on and below the metal reinforcement layer 630 may alleviate external impact or pressure, and may be formed, for example, using a nonwoven tape.

The outer sheath 650 has substantially the same function and characteristics as the inner sheath 610. An outer sheath of a cable used in a submarine tunnel, a terrestrial tunnel section, etc. may be formed of polyvinyl chloride having excellent flame retardancy, because fire is a risk factor that greatly affects manpower or equipment safety. An outer sheath of a cable used in a pipe conduct section may be formed of polyethylene having excellent mechanical strength and cold resistance.

Although not shown, the inner sheath 610 may be omitted and the metal reinforcement layer 630 may be directly provided on the metal sheath layer 500, and a bedding layer may be provided inside and outside the metal reinforcement layer 630 if necessary. That is, a bedding layer, a metal reinforcement layer, a bedding layer, and an outer sheath may be sequentially provided on an outer side of the metal sheath layer. This structure is preferable in terms of fatigue characteristics of the metal sheath layer 500, because the metal reinforcement layer 630 allows deformation of the metal sheath layer 500 but suppresses a change of an outer circumferential length thereof, a hydraulic pressure of the cable insulating layer 300 in the metal sheath layer 500 may be increased when electric current is supplied to the cable, a decrease in the hydraulic pressure, caused by contraction of the insulating oil due to a decrease in temperature of the cable when the supply of the electric current is stopped, may be compensated, and the insulating oil may be replenished by moving the insulating oil from a part having a high hydraulic pressure to a part, e.g., the inner semi-conductive layer 200, in which a hydraulic pressure sharply decreases due to the difference between the hydraulic pressures.

In addition, when the cable is a submarine cable, the cable protection layer 600 may further include a wire sheath 660, an outer serving layer 670 formed of polypropylene yarn or the like, etc. The wire sheath 660 and the outer serving layer 670 may additionally protect the cable from sea currents, reefs, etc. at the sea bottom.

While the present invention has been described above with respect to exemplary embodiments thereof, it would be understood by those of ordinary skilled in the art that various changes and modifications may be made without departing from the technical conception and scope of the present invention defined in the following claims. Thus, it is clear that all modifications are included in the technical scope of the present invention as long as they include the components as claimed in the claims of the present invention.

The invention claimed is:

1. A power cable comprising:

a conductor;

an inner semi-conductive layer covering the conductor;

an insulating layer covering the inner semi-conductive layer and impregnated with an insulating oil;

an outer semi-conductive layer covering the insulating layer;

a metal sheath layer covering the outer semi-conductive layer; and a cable protective layer covering the metal sheath layer, wherein the insulating layer is formed by sequentially stacking an inner insulating layer, an intermediate insulating layer, and an outer insulating layer, wherein the inner insulating layer and the outer insulating layer are formed by cross-winding kraft paper by gap winding and impregnating the kraft paper with the insulating oil, the intermediate insulating layer is formed by cross-winding semi-synthetic paper by gap winding and impregnating the semi-synthetic paper with the insulating oil, the semi-synthetic paper including a plastic film and kraft paper stacked on at least one side of the plastic film, the gap winding is performed by cross-winding a kraft paper or semi-synthetic paper to form regular gaps between the widths of the kraft paper or semi-synthetic paper, and repeatedly cross-winding a new kraft paper or semi-synthetic paper on the kraft paper or semi-synthetic paper to cover the gaps with the new kraft paper or semi-synthetic paper while gaps are formed between the widths of the new kraft paper or semi-synthetic paper, the intermediate insulating layer is divided into at least two layers according to a width of the semi-synthetic paper thereof, wherein, when a layer more adjacent to the conductor among the at least two layers is a lower layer and a layer located at an outer side of the lower layer is an upper layer, the width of the semi-synthetic paper forming the upper layer is greater than that of the semi-synthetic paper forming the lower layer, and a width of the gaps between the widths of the semi-synthetic paper, which are formed by gap-winding the semi-synthetic paper, is 5 to 15% of that of the semi-synthetic paper.

2. The power cable of claim 1, wherein in the upper layer and the lower layer adjacent to each other, the width of the semi-synthetic paper forming the upper layer is 105 to 125% of that of the semi-synthetic paper forming the lower layer.

3. The power cable of claim 1, wherein the width of the semi-synthetic paper forming the intermediate insulating layer adjacent to the inner insulating layer is the same as that of the semi-synthetic paper forming the inner insulating layer adjacent thereto.

4. The power cable of claim 1, wherein layers cross-wound a plurality of times in an S direction and layers cross-wound a plurality of times in a Z direction are alternately included in the insulating layer, and the intermediate insulating layer comprises at least two layers cross-wound in the S direction or the Z direction.

5. The power cable of claim 4, wherein the width of the semi-synthetic paper forming the S-direction wound layers or the Z-direction wound layers of the intermediate insulating layer is the same in the same S-direction wound layer or the same Z-direction wound layer.

6. The power cable of claim 4, wherein the number of times of winding the semi-synthetic paper in the same S-direction wound layer or the same Z-direction wound layer among the S-direction wound layers or the Z-direction wound layers of the intermediate insulating layer is 16 or less.

7. The power cable of claim 4, wherein, in the insulating layer, the difference between a sum of the numbers of times of winding the S-direction wound layers and a sum of the numbers of times of winding the Z-direction wound layers does not exceed ±10% of the sum of the numbers of times of winding the S-direction wound layers.

8. The power cable of claim 1, wherein the inner semi-conductive layer is formed by cross-winding the semi-conductive paper by gap winding and impregnating the semi-conductive paper with the insulating oil, and the outer semi-conductive layer is formed by cross-winding the semi-conductive paper by gap winding and impregnating the semi-conductive paper with the insulating oil, wherein the outer semi-conductive layer comprises:

a lower layer formed by cross-winding the semi-conductive paper by gap winding and impregnating the semi-conductive paper with the insulating oil; and an upper layer formed by cross-winding the semi-conductive paper and metallized paper together by lap winding and impregnating the semi-conductive paper and the metallized paper with the insulating oil.

9. The power cable of claim 1, wherein a thickness of the inner insulating layer is 1 to 10%, a thickness of the intermediate insulating layer is 75% or more, and a thickness of the outer insulating layer is 5 to 15%, based on a total thickness of the insulating layer, and resistivities of the inner insulating layer and the outer insulating layer are less than resistivity of the intermediate insulating layer.

10. The power cable of claim 9, wherein the thickness of the outer insulating layer is greater than that of the inner insulating layer.

11. The power cable of claim 10, wherein the thickness of the outer insulating layer is 1 to 30 times the thickness of the inner insulating layer.

12. The power cable of claim 1, wherein a thickness of the kraft paper of each of the inner insulating layer and the outer insulating layer is less than that of the kraft paper included in the semi-synthetic paper.

13. The power cable of claim 1, wherein a maximum impulse electric field value of the inner insulating layer is less than that of the intermediate insulating layer.

14. The power cable of claim 1, wherein a maximum impulse electric field value of the intermediate insulating layer is 100 kV/mm or less.

15. The power cable of claim 1, wherein a thickness of the plastic film is 40 to 70% of a total thickness of the semi-synthetic paper.

16. The power cable of claim 1, wherein the conductor is formed of annealed copper wire or aluminum, wherein the conductor comprises a flat conductor formed by stacking flat element wires in multiple layers on a round center wire or a circularly compressed conductor formed by stacking and compressing round element wires in multiple layers on a round center wire.

17. The power cable of claim 1, wherein the plastic film is formed of a polypropylene homopolymer resin.

18. The power cable of claim 1, wherein the insulating oil comprises a high-viscosity insulating oil of kinematic viscosity of 500 centistokes (Cst) or more at 60° C.

19. The power cable of claim 1, wherein the cable protective layer comprises an inner sheath, a bedding layer, a metal reinforcement layer and an outer sheath.

20. The power cable of claim 19, wherein the cable protective layer further comprises a wire sheath and an outer sheath layer.

* * * * *